US007197119B2

(12) United States Patent
Freudenberger et al.

(10) Patent No.: US 7,197,119 B2
(45) Date of Patent: Mar. 27, 2007

(54) HIGH-PERFORMANCE ANODE PLATE FOR A DIRECTLY COOLED ROTARY PISTON X-RAY TUBE

(75) Inventors: Jörg Freudenberger, Eckental (DE); Peter Röhrer, Bubenreuth (DE); Peter Schardt, Höchstadt/Aisch (DE)

(73) Assignee: Siemens Aktiengesellschaft, Munich (DE)

( * ) Notice: Subject to any disclaimer, the term of this patent is extended or adjusted under 35 U.S.C. 154(b) by 32 days.

(21) Appl. No.: 11/041,170

(22) Filed: Jan. 20, 2005

(65) Prior Publication Data

US 2005/0185761 A1 Aug. 25, 2005

(30) Foreign Application Priority Data

Jan. 22, 2004 (DE) ..... 10 2004 003 370

(51) Int. Cl.
*H01J 35/10* (2006.01)

(52) U.S. Cl. ..... 378/141; 378/127; 378/144

(58) Field of Classification Search ..... 378/119, 378/121, 122, 125, 127, 130, 141, 143, 144, 378/199, 200
See application file for complete search history.

(56) References Cited

U.S. PATENT DOCUMENTS 3,602,686 A * 8/1971 Lempert ..... 219/121.14
3,790,838 A * 2/1974 Baum ..... 378/129
3,795,832 A 3/1974 Holland ..... 378/127
3,836,807 A 9/1974 Schreiner et al. ..... 378/144
3,959,685 A * 5/1976 Konieczynski ..... 378/144
4,271,372 A 6/1981 Geldner et al. ..... 378/144
4,870,672 A * 9/1989 Lindberg ..... 378/129
4,928,296 A * 5/1990 Kadambi ..... 378/141
5,629,970 A * 5/1997 Woodruff et al. ..... 378/143
6,426,998 B1 * 7/2002 Hell et al. ..... 378/141

FOREIGN PATENT DOCUMENTS

DE 28 07 561 8/1979
DE 32 36 104 3/1984
DE 199 56 491 6/2001

* cited by examiner

*Primary Examiner*—Edward J. Glick
*Assistant Examiner*—Jurie Yun
(74) *Attorney, Agent, or Firm*—Schiff Hardin LLP

(57) ABSTRACT

A high-performance anode plate for a directly cooled rotary piston x-ray tube is formed of a high-temperature-resistant material such as tungsten, molybdenum or a combination of both materials. In the region of the focal spot path, the underside of the anode plate is shaped, and/or in this region a different highly heat-conductive material is inserted or applied, such that an improved heat dissipation and thus a lower temperature gradient results.

15 Claims, 2 Drawing Sheets

HIGH-PERFORMANCE ANODE PLATE FOR A DIRECTLY COOLED ROTARY PISTON X-RAY TUBE

BACKGROUND OF THE INVENTION

1. Field of the Invention

The present invention concerns a high performance anode plate for directly cooled rotary piston x-ray tubes formed of high temperature resistant material, for example tungsten, molybdenum or a combination of both materials.

2. Description of the Prior Art

High performance x-ray tubes can be cooled in two ways. The most effective known cooling method is direct cooling, especially by RET technology (Rotary-Envelope-Tube). Due to unavoidable high temperatures that arise in the focal point of an x-ray tube, the target material in the area of incidence must consist of a high temperature resistant material, such as tungsten or molybdenum. Generally a material composite that is a combination of both materials is employed. Conventional directly cooled anode plates formed of high performance x-ray tubes do not possess an optimized heat resistance, which limits performance with such a tube. A further weakness of known plates is non-optimal thermal coupling to the cooling medium, for instance water or oil. This means the thermal energy must be conducted away (expelled) over a relatively small surface area. The temperature specified for the cooling medium can not under any circumstances be exceeded at this surface otherwise abrupt vaporization or chemical breakdown (cracking) of the cooling medium could occur.

SUMMARY OF THE INVENTION

An object of the present invention is to provide such a high performance anode plate for a directly cooled rotary piston tube wherein improved heat removal, and thus higher available performance of the rotary piston tube are achieved.

This object is achieved in accordance with the invention by an anode plate with the underside of the anode plate, beneath the focal spot path, such that an improved heat conductance and therewith a lower temperature gradient results, compared to a high performance anode plate of the prior art.

The above object also is achieved in accordance with the invention by an anode plate having an underside with a recess therein containing an annular insert formed of a material with high heat conductance.

In the first embodiment of the invention the underside of the anode plate in the area of the focal spot path represents an isotherm, which is achieved to a first approximation by the underside in this area proceeding parallel to the focal spot path surface. Additionally, where significant heat removal to the fluid cooling medium in the area of the underside of the anode plate occurs a surface enlargement can be provided, for example a grooving design or ribbing or a roughening of the underside, for example by sandblasting.

In the further embodiment of the invention improvement of the heat conductance and therewith a reduction of the temperature gradient are achieved by a ring insert of a material with high conductance is disposed in a socket in the underside of anode plate beneath the focal spot path. The insert can be composed of copper or similar material and has a radius that is greater than the breadth of the focal spot on the underside and can be directly connected, vacuum-tight with the piston.

The ring insert acts as a temperature disperser such that the temperature is very effectively expelled downwardly and sideways, so that a greater part of the underside of the anode plate is available for heat transfer. The fact that tungsten and molybdenum are very highly heat resistant, while conversely copper is much less resistant to heat conduction, but instead is a very good heat conductor, is exploited. Only materials such as molybdenum and tungsten withstand the extremely high temperature in the focal spot path, while the ring insert of good heat conducting material, due to the resulting temperature gradient is considerably less temperature stressed, but instead dissipates the arriving heat extremely quickly and over a large area down to the cooling medium.

DESCRIPTION OF THE PREFERRED EMBODIMENTS

Figure 1:
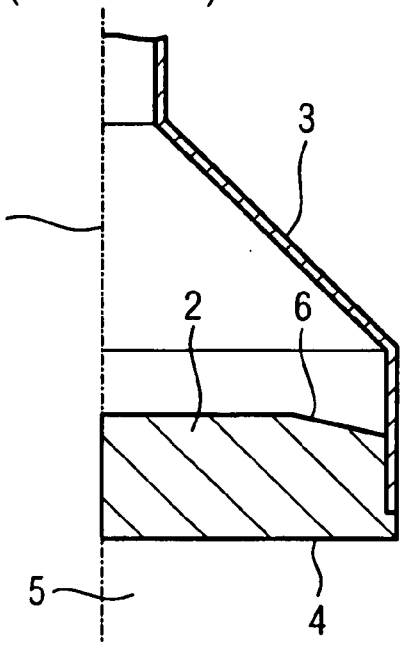
FIG 1 (PRIOR ART)
FIG. 1 is a schematic section through a rotary piston tube with a conventional high-performance (high-capacity) anode plate.

FIG. 1, shows the axis of symmetry 1 of a rotary anode tube, around which the anode plate 2 formed of tungsten and/or molybdenum rotates. The cathode is fashioned in a conventional manner and is therefore not shown in the drawings. The rotary piston tube has a piston 3 that rotates in the coolant. The anode plate 2, the underside 4 of which is in direct contact with the surrounding coolant 5, also rotates with the piston 3.

Figure 2:
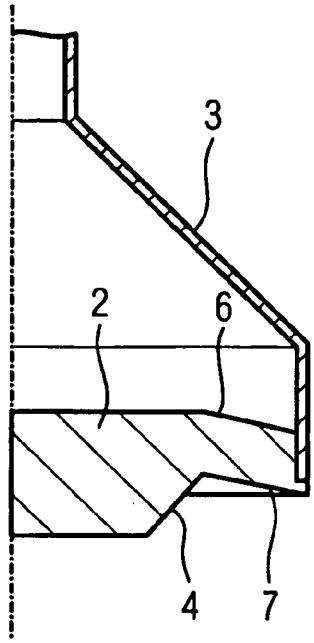
FIG. 2, corresponding to FIG. 1, is a section through an inventive arrangement with an anode plate adapted to the prevailing isotherm.

In order to achieve a better head dissipation from the highly-stressed focal spot on the focal path surface 6 downwardly to the underside 4 of the anode plate 2, in the exemplary embodiment according to FIG. 2 a geometric adaptation of the plate shape is made such that the anode plate 2 has a slanted backside 7 that lies approximately parallel to the focal path surface 6 and thus substantially in an isotherm, since the isotherms run approximately parallel to the focal path surface. In this manner, a uniform temperature results on this region 7 of the underside 4 of the anode plate, and therewith an improved heat dissipation. This is further improved in the exemplary embodiment according to FIG. 2 by this region 7 of the underside of the anode plate 2 being provided with a surface elevation (grooving or roughening that further) increases the heat transfer.

Figure 3:
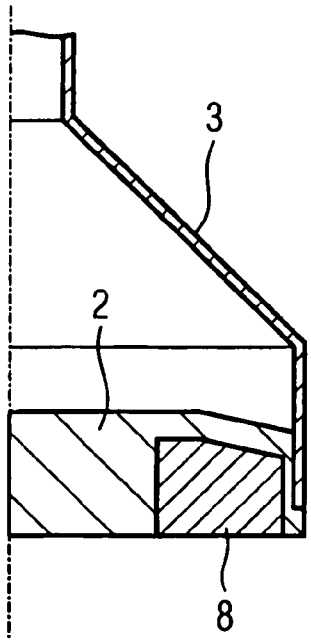
FIG. 3, corresponding to FIG. 2, is a section through an arrangement with an additional temperature spreader made of copper.

FIG. 3 shows a design embodiment of a high-performance anode plate that, in addition to the shaping of the tungsten/molybdenum anode plate adapted to the isotherms is provided with a heat dispenser made of a highly heat-conductive material such as, for example, copper. Inserted into the underside of the anode plate 2 is an annular insert 8 made of copper that, although it is by far not as highly temperature resistant as tungsten or molybdenum, can dissipate the heat much better. This achieves the advantage that the heat not only is conducted directly downwardly under the focal path, but also a lateral dissipation ensues, such that the overall surface on which an effective cooling can ensue (underside of the copper ring insert 8) is significantly larger, and therewith an increase of the heat dissipation is achieved. All of these measures lead to a lesser temperature gradient, meaning the temperature difference between the focal spot and the underside of the anode plate in contact with the coolant is less, and thus the danger of a fissure formation or other damages to of the anode plate is less given correspondingly higher stress. In other words, a rotary piston tube can be operated with higher capacity due to the inventive measures.

Figure 4:
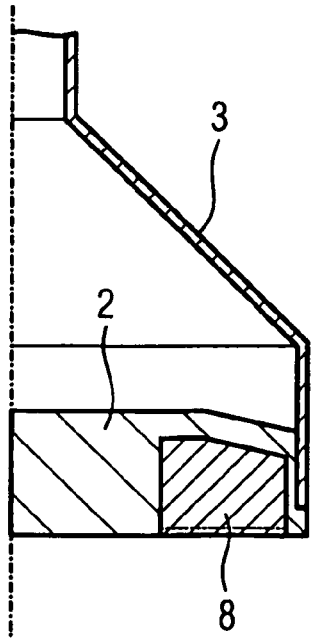
FIG. 4 shows a variant of the arrangement according to FIG. 3 with additionally improved cooling area for coolant.

FIG. 4 shows a design according to FIG. 3 but wherein the underside of the copper ring insert 8 is additionally provided with grooves or with a rough surface, produced, for example via sandblasting, so as to increase the surface area.

Figure 5:
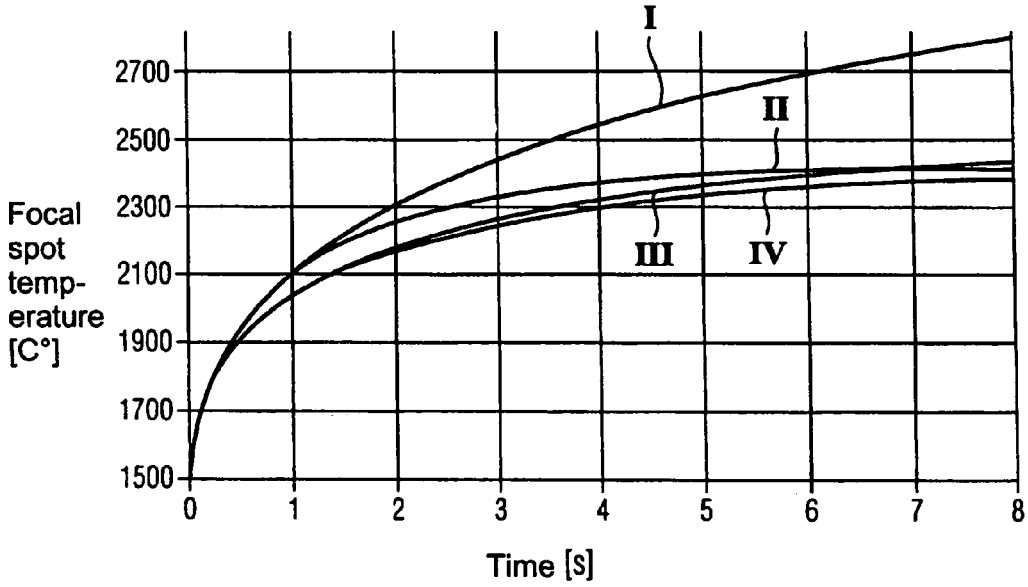
FIG. 5 shows respective curves of the focal spot temperature with respect to time for the anode plates shown in FIGS. 1–4.

In a diagram, FIG. 5 shows the focal spot temperature in degrees Celsius plotted over the time, wherein the different curves refer to rotary piston tubes with different anode plates, corresponding to FIG. 1 through 4. Curves I through IV stand for the anode plates of FIG. 1 through 4.

Given identical stress, an anode plate according to the prior art leads, after a short time, to clearly higher focal spot temperatures (curve I) than the inventive variants according to curves II through IV.

The invention is thus based on two basic features, first a maximal heat flow density is enabled by means of the optimized heat resistance. Either a plate of minimal thickness or suitable composition is decisive for this. Secondly, an additional optimization can be achieved by the heat dispenser (copper annular insert), the grooves or the sandblasting, since the heat at the anode underside can be dispensed onto a larger surface. The first feature is of greater significance than the second.

Although modifications and changes may be suggested by those skilled in the art, it is the intention of the inventors to embody within the patent warranted hereon all changes and modifications as reasonably and properly come within the scope of their contribution to the art.

We claim:

1. In a rotary piston x-ray tube directly cooled by coolant surrounding the x-ray tube, the improvement of an anode plate comprising:

an anode plate body having a topside, adapted to interact with an electron beam along a focal spot path to generate x-rays, and having an underside facing away from said topside;

said anode plate body being composed of material selected from the group consisting of tungsten, molybdenum, and tungsten/molybdenum combinations;

said anode plate body having a non-uniform thickness between said topside and, said underside, with the thickness beneath said focal spot oath being less the thickness of a remainder of the anode plate body; and said underside of said anode plate body having a region beneath said focal spot path proceeding substantially parallel to a surface of said topside at which said focal spot oath is located and being in direct contact with said coolant.

2. The improvement of claim 1 wherein said underside of said anode plate body has a portion thereof adapted to contact cooling fluid, said portion having a structure forming a surface enlargement in said portion.

3. The improvement of claim 2 wherein said structure comprises grooves.

4. The improvement of claim 2 wherein said structure comprises ribs.

5. The improvement of claim 2 wherein said structure comprises a roughening of said underside at said portion.

6. The improvement of claim 5 wherein said roughening comprises a sandblasted portion of said underside.

7. In a rotary piston x-ray tube directly cooled by coolant surrounding the x-ray tube, the improvement of an anode plate comprising:

an anode plate body having a topside, adapted to interact with an electron beam along a focal spot path to generate x-rays, and having an underside facing away from said topside;

said anode plate body being composed of material selected from the group consisting of tungsten, molybdenum, and tungsten/molybdenum combinations; and said underside having an annular recess therein beneath said focal spot path, and containing an annular insert in said recess, said annular insert being formed of a highly heat-conductive material for promoting heat dissipation and producing a low temperature gradient, and said annular insert being in direct contact with said coolant.

8. The improvement of claim 7 wherein said recess and said insert therein at said underside are disposed substantially parallel to a surface of said topside at which said focal spot path is disposed.

9. The improvement of claim 7 wherein said annular insert is formed of copper.

10. The improvement of claim 9 wherein said annular insert has a radial width that is larger than a width of said focal spot path.

11. The improvement of claim 7 wherein said underside of said anode plate body has a portion thereof adapted to contact cooling fluid, said portion having a structure forming a surface enlargement in said portion.

12. The improvement of claim 11 wherein said structure comprises grooves.

13. The improvement of claim 11 wherein said structure comprises ribs.

14. The improvement of claim 11 wherein said structure comprises a roughening of said underside at said portion.

15. The improvement of claim 14 wherein said roughening comprises a sandblasted portion of said underside.

* * * * *